US006909380B2

(12) United States Patent
Brooke

(10) Patent No.: US 6,909,380 B2
(45) Date of Patent: Jun. 21, 2005

(54) CENTRALIZED TRAFFIC SIGNAL PREEMPTION SYSTEM AND METHOD OF USE

(75) Inventor: O'Neil Brooke, Nepean (CA)

(73) Assignee: Lockheed Martin Corporation, Bethesda, MD (US)

( * ) Notice: Subject to any disclaimer, the term of this patent is extended or adjusted under 35 U.S.C. 154(b) by 72 days.

(21) Appl. No.: 10/406,250

(22) Filed: Apr. 4, 2003

(65) Prior Publication Data

US 2004/0196162 A1 Oct. 7, 2004

(51) Int. Cl.[7] ..... G08G 1/07
(52) U.S. Cl. ..... 340/906; 340/907; 340/988
(58) Field of Search ..... 340/902, 904, 340/905, 906, 907, 909, 910, 914, 917, 988; 701/117, 118, 119, 220

(56) References Cited

U.S. PATENT DOCUMENTS

| | | | | |
|---|---|---|---|---|
| 5,539,398 A | | 7/1996 | Hall et al. | 340/907 |
| 5,602,739 A | | 2/1997 | Haagenstad et al. | 340/906 |
| 5,757,284 A | | 5/1998 | Trizzino et al. | 340/902 |
| 5,889,475 A | | 3/1999 | Klosinski et al. | 340/902 |
| 5,926,113 A | | 7/1999 | Jones et al. | 340/906 |
| 6,012,012 A | * | 1/2000 | Fleck et al. | 701/117 |
| 6,064,319 A | | 5/2000 | Matta | 340/917 |
| 6,125,326 A | | 9/2000 | Ohmura et al. | 701/213 |
| 6,133,854 A | * | 10/2000 | Yee et al. | 340/907 |
| 6,243,026 B1 | | 6/2001 | Jones et al. | 340/906 |
| 6,246,954 B1 | | 6/2001 | Berstis et al. | 340/906 |
| 6,317,058 B1 | | 11/2001 | Lemelson et al. | 340/910 |
| 6,321,161 B1 | | 11/2001 | Herbst et al. | 340/905 |
| 6,326,903 B1 | | 12/2001 | Gross et al. | 340/988 |
| 6,339,382 B1 | | 1/2002 | Arbinger et al. | 340/903 |
| 6,341,255 B1 | | 1/2002 | Lapidot | 340/905 |
| 6,417,782 B1 | | 7/2002 | Darnall | 340/902 |
| 6,427,113 B1 | | 7/2002 | Rahman | 340/907 |
| 6,442,394 B1 | | 8/2002 | Valentine et al. | 340/905 |
| 6,442,473 B1 | | 8/2002 | Berstis et al. | 340/905 |
| 6,587,778 B2 | * | 7/2003 | Stallard et al. | 701/117 |
| 6,621,420 B1 | * | 9/2003 | Poursartip | 340/907 |
| 6,633,238 B2 | * | 10/2003 | Lemelson et al. | 340/909 |
| 2001/0029425 A1 | | 10/2001 | Myr | |
| 2001/0050620 A1 | | 12/2001 | Lee | |
| 2002/0126022 A1 | | 9/2002 | Ellis | |

OTHER PUBLICATIONS

Arthur J. Dock, "Using GPS/GIS to Test Emergency Vehicle Traffic Signal Preemption", www.s kit .c m/p0798.htm.
Grenfield Associates, "GPS and Traffic Control—Priority One—The Traffic Preemption System for Emergency Vehicles Based on Differential GPS and Two–Way Radio", htt://www.greenf.c m/traffic.htm.
San Joaquin valley Intelligent Transportation System (ITS) Strategic Deployment Plan Working Paper #5.

* cited by examiner

*Primary Examiner*—Van T. Trieu
(74) *Attorney, Agent, or Firm*—Greenblum & Bernstein, P.L.C.

(57) ABSTRACT

A system and method of centralizing traffic signal preemption for roadway emergency operations provides for increased accuracy and coordination of emergency response vehicles along an emergency route. A centralized preemption system receives status and location information, e.g., GPS, from emergency vehicles via fleet management systems or dispatch centers. As an emergency route is determined and projected in real-time, predetermined policies are applied to create an overall preemption plan of traffic lights at intersections along an anticipated route. The preemption plan results in preemption directives being transmitted to traffic management systems that are controlling traffic signal controllers at intersections along the route. The centralized preemption system may coordinate among many traffic management systems that provides for a much larger preemption service area including multiple jurisdictions.

29 Claims, 9 Drawing Sheets

CENTRALIZED TRAFFIC SIGNAL PREEMPTION SYSTEM AND METHOD OF USE

BACKGROUND OF THE INVENTION

1. Field of the Invention

The present invention generally relates to a traffic signal preemption system and, more particularly, a system and method that provides centralized preemption of traffic signals based on vehicle activity across diverse systems.

2. Background Description

Traffic preemption control systems have been utilized in present day localities to provide preemptive control of traffic signals and to provide traffic flow control for various types of vehicles such as ambulances, police cars, fire trucks, buses, special convoys, and the like, and denoted as emergency vehicles (EV) hereinafter. The term emergency vehicle (EV) is not limiting to only emergency vehicles, but includes any vehicle for which traffic preemption is provided.

In general, traffic signal preemption is a process that allows emergency vehicles to temporarily change the timing plans of traffic signals so that the emergency vehicles do not have to wait for a red light and achieve right of ways.

Referring to FIG. 1, a typical approach has been to provide equipment within the emergency service vehicle 100 that includes a preemption interface 101 and a transceiver 102 that is capable of broadcasting an emergency signal 105 to a transceiver 106 associated with a particular traffic signal controller (TSC) 108. A traffic signal control cabinet 110 houses various equipment that typically includes a communication subsystem 109, TSC 108, a transceiver 106 (or simply a receiver) and a field preemption interface device 107. The TSC 108 typically controls lights at only one roadway intersection. Various modes of communications have been utilized to broadcast the emergency signal 105 such as sensors under the roadway, radio transmissions, infrared signals, ultrasonic signals, all requiring a least a receiver of appropriate type at each intersection along a possible route of EV to receive the emergency signal 105 and a corresponding transmitter in the emergency service vehicle 100.

An emergency vehicle also has communication equipment that provides communication with its fleet management system and dispatch center. Dispatch centers typically provide the initiating directives that place an EV in emergency mode and convey necessary emergency information such as location, directions, other responding services, etc.

A traffic management system 115 may communicate 120 with an individual TSC 108 in order to update timing plans. The TMS includes a communication subsystem (not shown) that provides communication 120 with TSC 108 via communications subsystem 109. This communication 120 is typically through a communications subsystem 109 that is either integral with or proximate to the TSC 108. The communication 120 may involve coax connectivity, Integrated Services Digital Network (ISDN), fiber, copper, dial-up modems running various baud rates, or radio link. The traffic management system 120 typically controls traffic signal controllers within a particular jurisdiction. Multiple traffic management systems may exist within jurisdictions.

Each of these technologies have unique problems such as maintenance issues for under the roadway systems or passing traffic can interfere with infrared signals and ultrasonic signals. Obstructions may also interfere with this technology. Other problems include determining the arrival time of an EV at a particular intersection. Radio control systems utilize signal strength measurements to anticipate arrival times of EVs at intersections; however, preemption of traffic signals too early can lead to impatient drivers proceeding through an intersection causing potential accident risks. Additionally, preemption too late may cause undesirable delays in the EVs progress. Optimizing the coordinating the traffic signal preemption with arrival of the EV is an important consideration in traffic control systems. Additionally, these types of systems are typically dedicated specific components, making them useful only to the agencies that have purchased such systems.

FIG. 2 shows another illustrative variation of recent approaches that includes a differential global positioning system (GPS) in each EV 130. This type of system may include a vehicle CPU 131 that may facilitate the preemption interface, a vehicle communication radio system 132 with radio antenna 133, and a GPS subsystem 134 for receiving and processing GPS signals. The vehicle communication radio subsystem 132 may include various types of technologies and the radio antennas may include multiple distinct antennas for the different types of communications used in the EV 130. In this type of system, the GPS subsystem 134 provides location information to the vehicle CPU 131, which, in turn, provides updates and exchange of status information through the vehicle communication radio subsystem 132 and radio antenna 133 to a TSC 140. These EV components may take on varying arrangements as necessary.

As part of the traffic signal control cabinet (TSCC) 140, a TSC 108 controls operation of the traffic signal and interfaces with an intersection CPU 142 that receives information from a stationary reference GPS subsystem 143 for additional refinement and correction of deviations of GPS position information received from the EV 130 via a radio signal 146. The TSCC 140 also includes a communication radio subsystem 144 and radio antenna 145 for receiving the radio signals 146. Here again, the TSCC 140 typically has a communication subsystem 109, either integral or non-integral, for communicating with a traffic management system 115 in the same manner as discussed previously. Other arrangements and connectivity of cabinet components may exist.

In the GPS type system of FIG. 2, as an EV approaches an intersection, the current location is repeatedly transmitted to the proximate intersection TSC, such as 108. The intersection traffic signal controller receives GPS location data and status information from an approaching EV and can calculate the arrival rate and direction of the vehicle and can subsequently control the preemption of the traffic signals with greater accuracy and with minimized impact on traffic flow.

Now, when any of these above described exemplary systems are deployed, the preemption interaction is solely between emergency vehicle and the intersection traffic controller. Additionally, the technology in use is localized to a given jurisdiction or locality. Accordingly, EVs deployed in a given locality must then comply with the traffic preemption techniques and systems that are in place for that locality in order to receive benefits of any traffic preemption systems. But, on occasion, EVs must traverse into, or through, other localities other than those for which the EV is normally intended to provide emergency or other service. In this case, the type of preemption equipment in the EV may be incompatible with traffic control systems installed at intersections.

This, of course, poses many logistical problems and may also attribute to slow response times.

Another limitation of the above systems includes the lack of a centralized traffic management system that is capable of coordinating essentially all EVs and traffic light preemption decisions within a broader geographical area, which may include multiple jurisdictions, multiple fleet management systems, or multiple traffic management systems. Since, generally, all of the above systems communicate only between the EV and a proximate traffic light controller that is local to an intersection, comprehensive coordination of traffic lights along an entire route cannot be provided. Nor, in these systems, can coordination of complementing emergency vehicles (e.g., police and fire trucks together) for a given emergency or similar situation be provided.

The present invention is directed to overcoming one or more of the problems or disadvantages associated with the prior art.

SUMMARY OF THE INVENTION

In one aspect of the present invention, a method is provided for preempting traffic signals at intersections for emergency vehicles (EV) or other vehicles. The method includes transmitting status information from a vehicle to a centralized preemption system where a route and a preemption plan is determined by the centralized preemption system using policy rules and the status information. After the route and preemtpion plan is determined, a preemption directive is sent to one or more traffic signal controllers related to the route occurs causing an alteration of a traffic signal cycle.

In embodiments, the policy rules include at least one of the following:

(i) whether a traffic signal is controlled by a traffic management system, (ii) intersections involved, (iii) an agency requesting preemption, (iv) type of vehicle involved, (v) type of emergency, (vi) severity of an emergency, (vii) location of the vehicle, (viii) destination of the vehicle, (ix) time-of-day, day of week, whether it is a holiday, whether it is a work day, (x) traffic density, (xi) requested emergency route, (xii) proposed route, (xiii) direction, and (xiv) speed.

In a second aspect of the invention, the method includes transmitting status information from a vehicle where it is received at a management system. The management system determines which centralized preemption system should receive the status information and retransmits the status information to the determined centralized preemption system. The determined centralized preemption system determines a route and preemption plan by using policy rules and the status information. A preemption directive is then sent according to the preemption plan to one or more traffic signal controllers related to the route to thereby coordinate the one or more traffic signal controllers.

In another aspect of the present invention, a system is provided for providing centralizing traffic signal preemption. The system includes a component for receiving status information from an EV at a management system that determines which centralized management system or systems should receive the status information. The system further includes a component for retransmitting the status information to the determined centralized preemption system or systems and a component for determining a route and a preemption plan using policy rules and the status information. The system further includes a component for sending a preemption directive according to the preemption plan to one or more traffic signal controllers related to the route, wherein the preemptive directives alters a traffic signal cycle.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A DETAILED EMBODIMENT OF THE INVENTION

The present invention is directed to a system and method that provides centralized preemption of traffic signals based on vehicle activity and predefined policy rules. In this method and system of the present invention, centralized preemption and coordination of multiple traffic management systems (TMS) is provided within one or more jurisdictions. Further, this method and system provides for centralized preemption of diverse fleets such as, for example, police, fire, ambulance, rescue, buses, and special convoys. This provides substantial improvement in delivering emergency type services and centralized preemption to communities using existing deployed traffic control systems. This may involve one or more jurisdictions such as counties, cities, states, municipalities, etc.

Embodiments of the Present Invention

Figure 3:
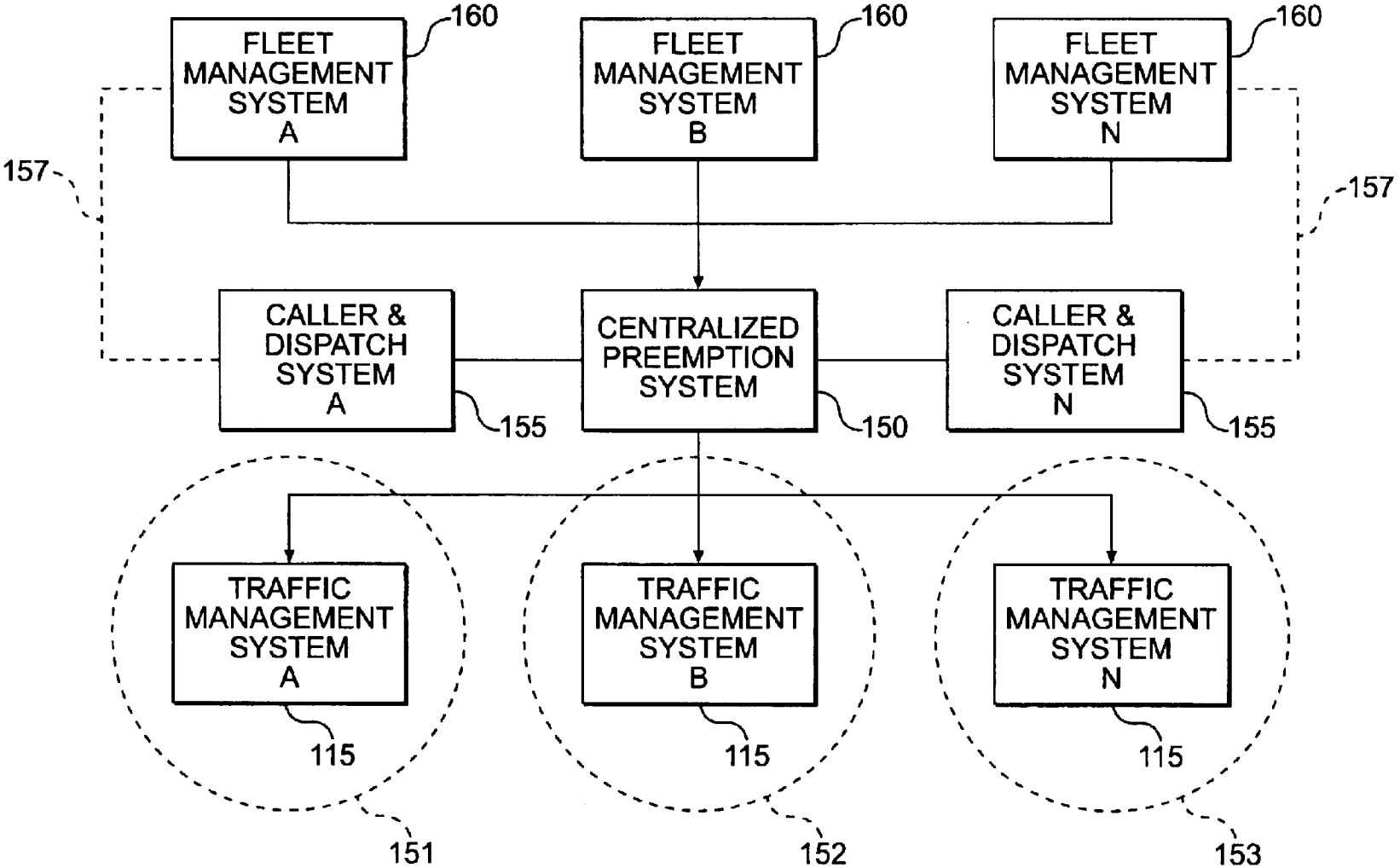
FIG. 3 is a block diagram showing components of an embodiment of the present invention.

FIG. 3 represents an overall view of an embodiment of the present invention. A Centralized Preemption System (CPS) 150 is shown to be in communication with Fleet Management Systems (FMS) 160 and Traffic Management Systems (TMS) 115. The CPS 150 provides a comprehensive mechanism to coordinate among diverse FMSs 160 and multiple TMSs 115, and across localities, wide geographical regions, or diverse jurisdictions. Additionally, the CPS 150 can communicate with one or more caller and dispatch systems 155. This provides for additonal flexibility to communicate amongst various diverse systems.

The caller and dispatch system 155 encompasses all dispatch center functions and relays requests, emergency status information concerning situations, EV status and position to the CPS 150. The caller and dispatch systems 155, FMS 160, and TMS 115 may be the responsibility of different jurisdictions (e.g., state, city, county, federal, or private sector entities) designated as reference numerals 151, 152, or 153. It should be understood by those of ordinary skill in the art that the present invention is not limited to only three different jurisdictions, but may be used across any number of jurisdictions, diverse locales and systems. By using the present invention, the real-time operational information flow within the fleets and systems is now made available to the CPS 150. The CPS 150 can then issue emergency control preemption directives to the one or more traffic management systems 115 that provide intersection traffic light preemption to traffic light controllers such as 108 or 140 throughout any number of different localities or jurisdictions. This centralization provides for comprehensive flexible preemption policy rules to be predetermined, coordinated, and implemented on a larger scale. The CPS 150 may be provided as part of multi-jurisdictional operations, within cities, counties, metropolitan areas, or the like.

In the present invention, the fleet management systems 160 track the whereabouts of an individual EV (e.g., 130) and manages its operational availability and places it into service under control of dispatch centers. As an example, there is often individual FMSs for police departments and another for a fire department. Others may also exist. Alternately, a combined FMS may manage more than one type of emergency response fleet.

Figure 1:
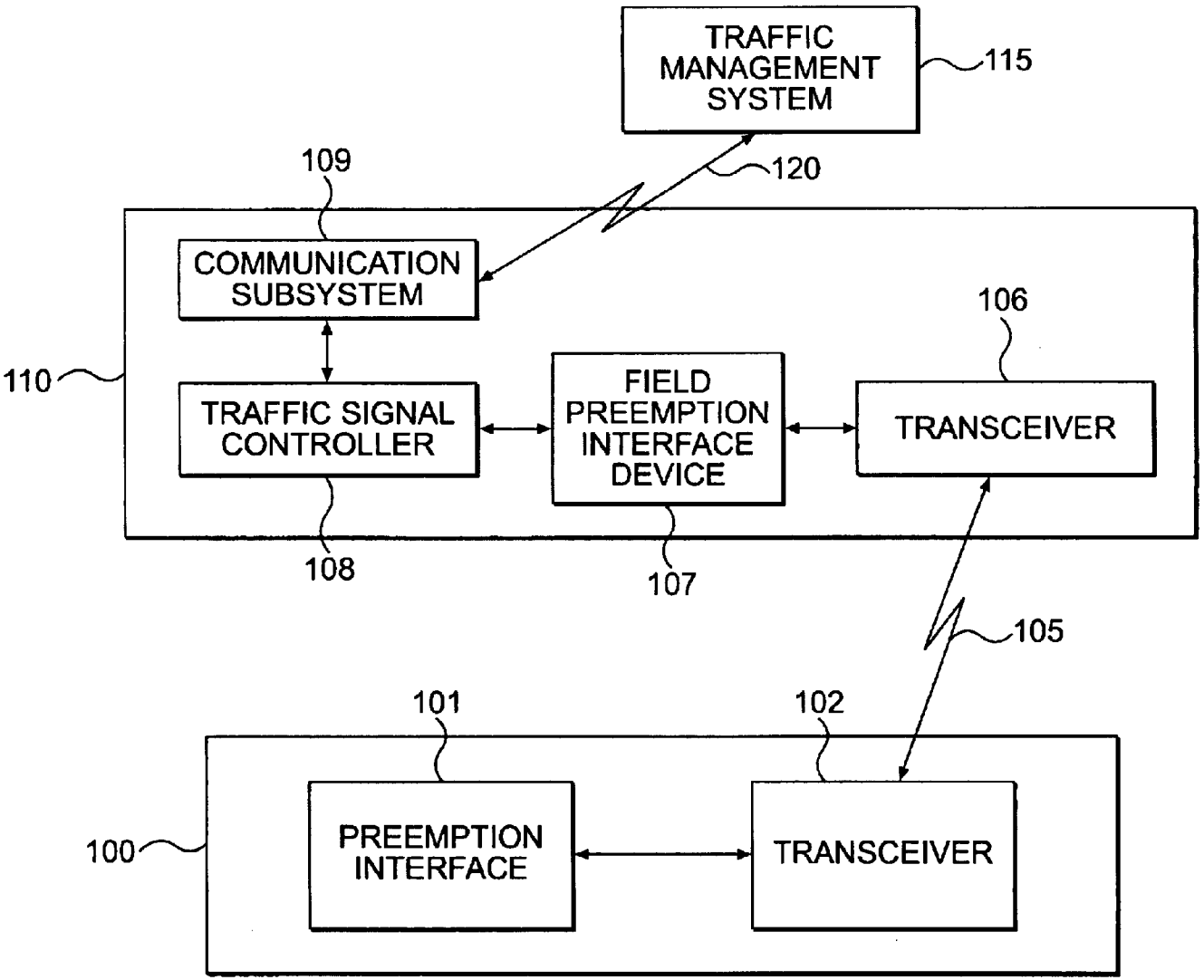
FIG. 1 PRIOR ART
FIG. 1 is an exemplary block diagram of an emergency vehicle and traffic signal controller.
Figure 2:
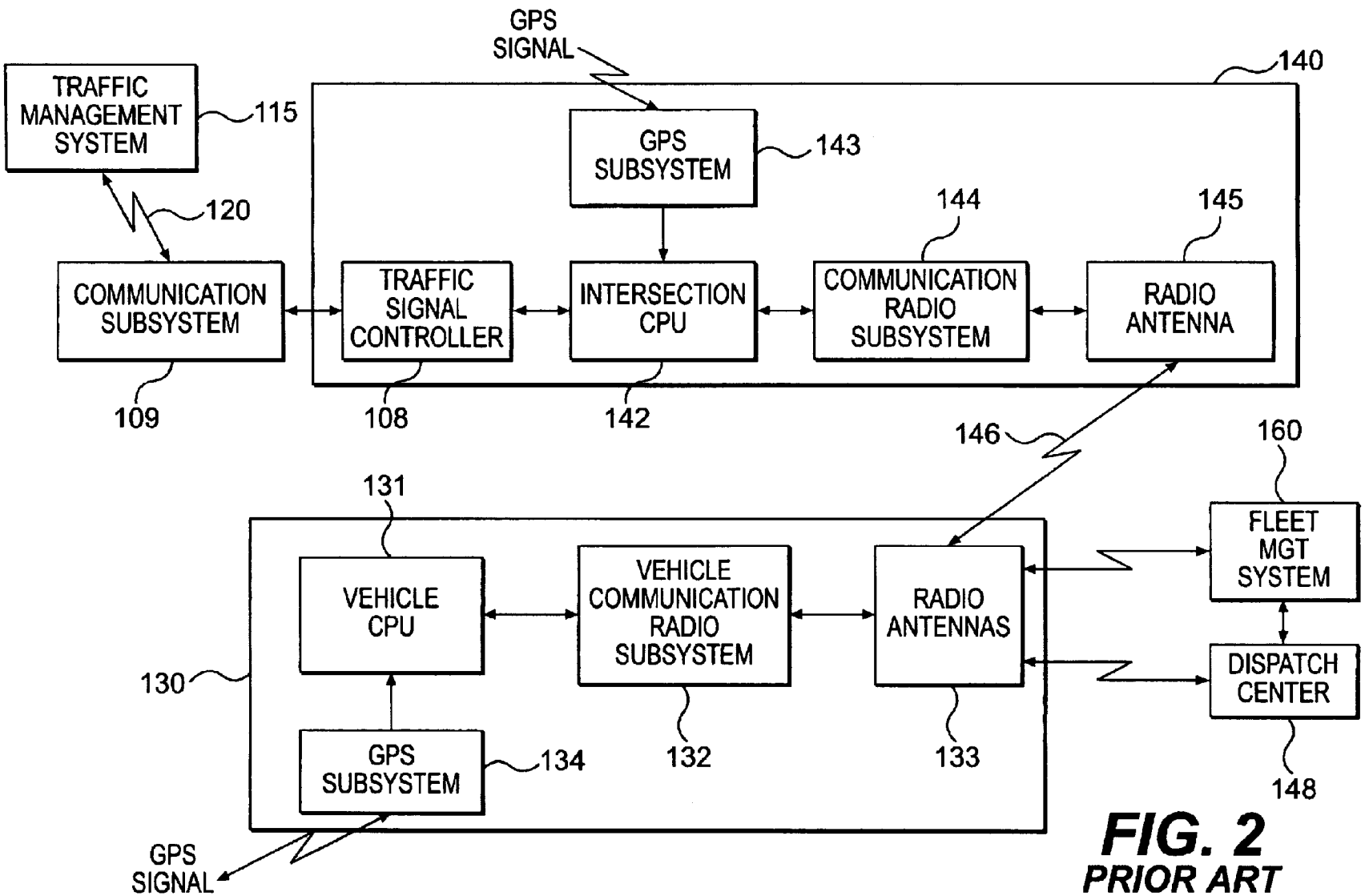
FIG. 2 PRIOR ART
FIG. 2 is an exemplary block diagram another emergency vehicle and traffic signal controller with traffic management system, fleet management system and dispatch center system.

GPS and mobile data terminals also communicate with dispatch centers via private radio frequencies, cellular digital packet data (CDPD), or cellular. When the EV transmits its status, including location, to the FMS, the information is, in turn, provided to a CPS 150, either from the FMS 160, or from the caller and dispatch system 155. This transmission is particularly required when an EV becomes active in an emergency. The FMS may each be associated with jurisdictions such as 151, 152, or 153, or parts of jurisdictions within a geographic area or a city. Fleet management 160 may be co-located with caller and dispatch centers 155. Caller and dispatch centers 155 may also be jurisdictional or multi-jurisdictional. Caller and dispatch centers 155 can also be in direct communication with any EV as required. The CPS 150 is also in communication with traffic management systems (shown in FIG. 1). The traffic management systems may also be associated with one or more individual jurisdictions such as 151, 152, or 153.

Emergency vehicles, or the like, transmit status information, which may include a wide range of information, e.g., location (GPS or other), mode of operation, level of preemption (e.g., level of emergency), destination request, route request, operational or patient condition, traffic conditions and the like. As EV status information is transmitted by the EV, and received and processed by the computer-based CPS 150, the position and direction of the EV, is ascertained, tracked, and associated with road-system routes. When any EV enters preemption mode of operation, as indicated in the real-time communications from the vehicles to the FMS, or alternatively, via communications from the caller and dispatch system 155, the position and direction of travel of the EV is mapped in real-time from GPS information, as needed, to the appropriate highway route or routes. Any translation of information such as GPS latitude/longitude to other coordinate systems, such as relative x/y coordinate systems for example, is performed as needed, depending on the particular entity transmitting or receiving the information.

Still referring to FIG. 3, status information possibly including destination information supplied from the EV to the FMS 160 or to the caller and dispatch system 155 to the CPS 150 is used to project arrival times at intersections for one or more selected routes. As route information from a geophysical subsystem is weighed and route policy applied for the type of emergency and destination involved, a traffic light preemption plan is developed and committed. This plan may be simple (e.g., one directive to one TSC) or very extensive involving many traffic signal controllers, TMSs, or other equipment, depending on the application of the present invention. Preemption timing is also computed based on the route and equipment involved according to the plan. The preemption plan is then converted to preemption directives taking into account any timing requirements. As situations vary with time, route preemption timing (or equipment involved) may be updated with subsequent preemption directives as necessary. Preemption directives are issued to the appropriate traffic management systems, or directly to a TSC, if the CPS 150 is in direct communication with a TSC.

Caller and dispatch systems can also provide destination status information to a CPS on behalf of a vehicle. Fleet management systems may also supply direction and speed information to a CPS.

Depending on the route and destination, multiple TMSs 115 may be included in the preemption plan. The communications to the TMSs 115 are issued in the formats required by the particular type of traffic management system receiving the communication. Since different models and manufacturers of traffic management systems, traffic light controllers exist, translation of location information and timing may take place either in the CPS 150 or the traffic management system 115. The traffic management systems in turn issue preemption override messages (i.e., re-transmitted preemption directives) to the traffic light controllers (in a manner that is appropriate for the particular traffic light controller involved). The directives may include immediate action requirements or delayed action requirements. Intersection traffic light's cycle timing may be altered (e.g., shortened, lengthened, skipped, or set to a steady state, etc.) in anticipation of the probable arrival of an EV. This may help, for example, to condition the traffic flow into a more efficient situation in anticipation of a complete imminent override (for example, to clear out a left turning lane or similar maneuver). Multiple intersection's operations may be adjusted in this fashion along a route in order to anticipate an EV transit.

Figure 4:
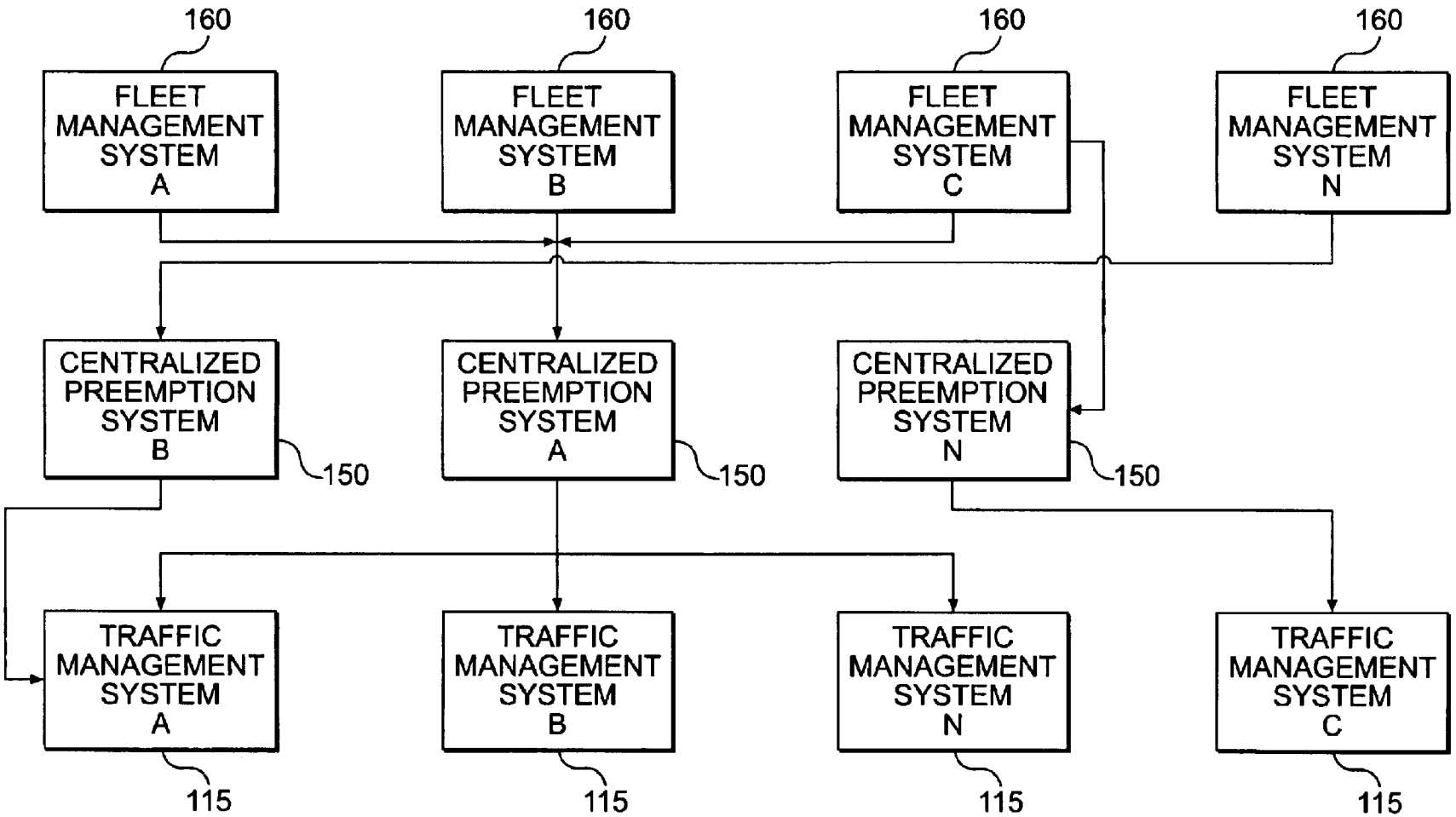
FIG. 4 is a block diagram showing an exemplary configuration of an embodiment of the present invention.

FIG. 4 shows the application of the present invention with multiple CPSs 150. In this embodiment, FMS 160 can be in communication with just one CPS 150, as shown by FMS N and CPS B. Alternatively, a FMS 160 may be in communication with more than one CPS 150. This is demonstrated by the relationship of FMS C with CPS 150, A and N. CPS 150, A, may also be in communication with multiple FMS's 160, such as A, B and C. A one to one or one to many relationship may also exist between the CPS 150 and traffic management systems 115 as shown also in FIG. 4. It is conceivable, though, that the CPS 150 may also perform the role of one or more traffic management systems 115. In any scenario, the system and method of the present invention is capable of providing communication across diverse systems and coordinating emergency efforts (as discussed throughout).

Figure 5:
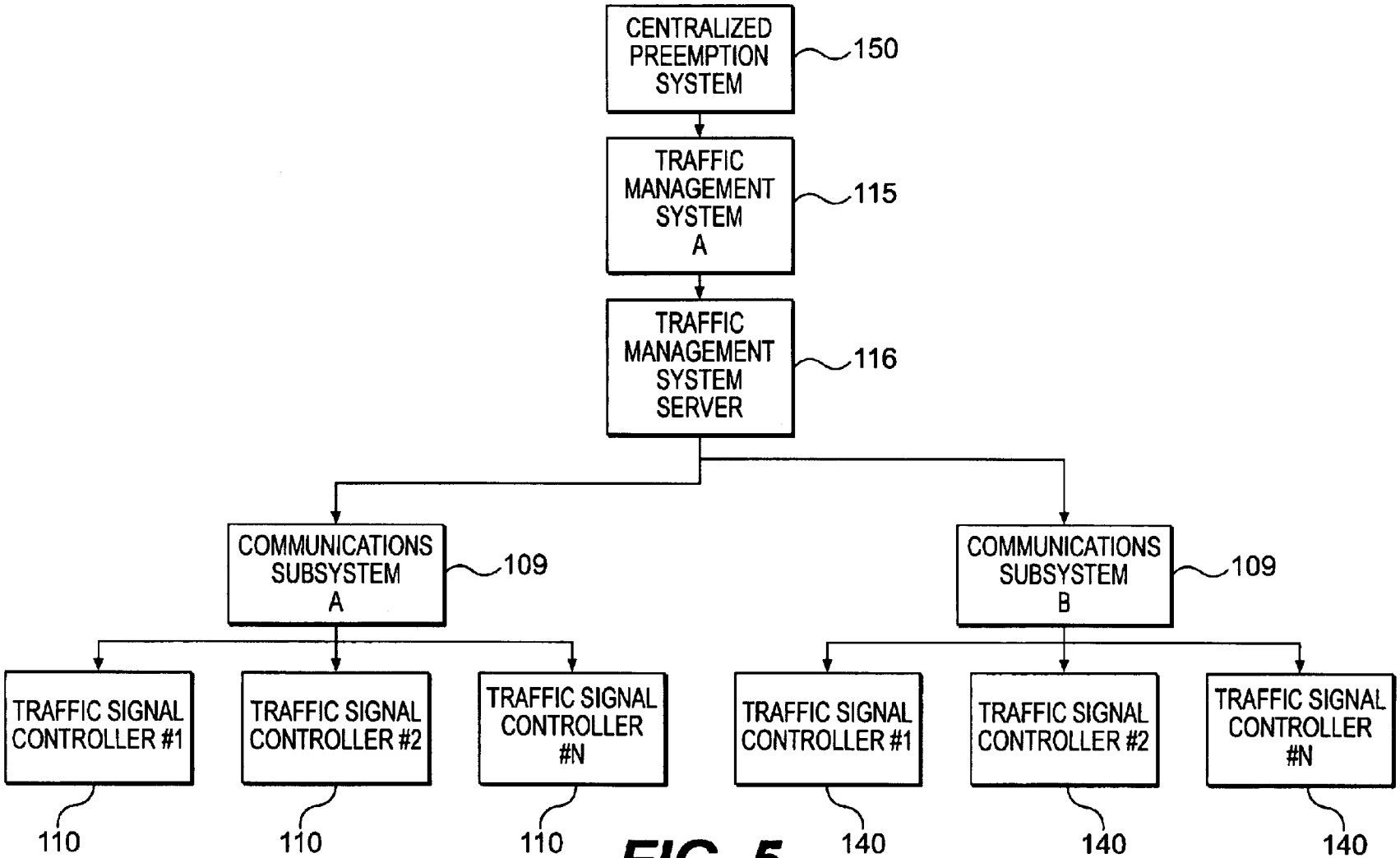
FIG. 5 is a block diagram showing an exemplary configuration according to an embodiment of the present invention.

FIG. 5 shows another embodiment of the CPS of the present invention illustrating alternate connectivity from the CPS 150 to the TSCs (e.g., 108 and 140). In this embodiment, a traffic management system server 116 is used to facilitate multiplexing of communications from a TMS 115 to one or more communications subsystems 109*a* or 109*b*, and may provide maintenance and diagnostic functions. As shown, the communications subsystem 109a may service multiple TSCs 108 and the communications subsystem 109b may service multiple TSCs 140. This increases cost performance by decreasing infrastructure overhead. It should be noted that any type of TSC might be employed as long as compatible interfaces can be established to the CPS 150 and necessary messaging protocols provided. The traffic management system server 116 may also be included as part of the traffic management system 115 itself.

Figure 6:
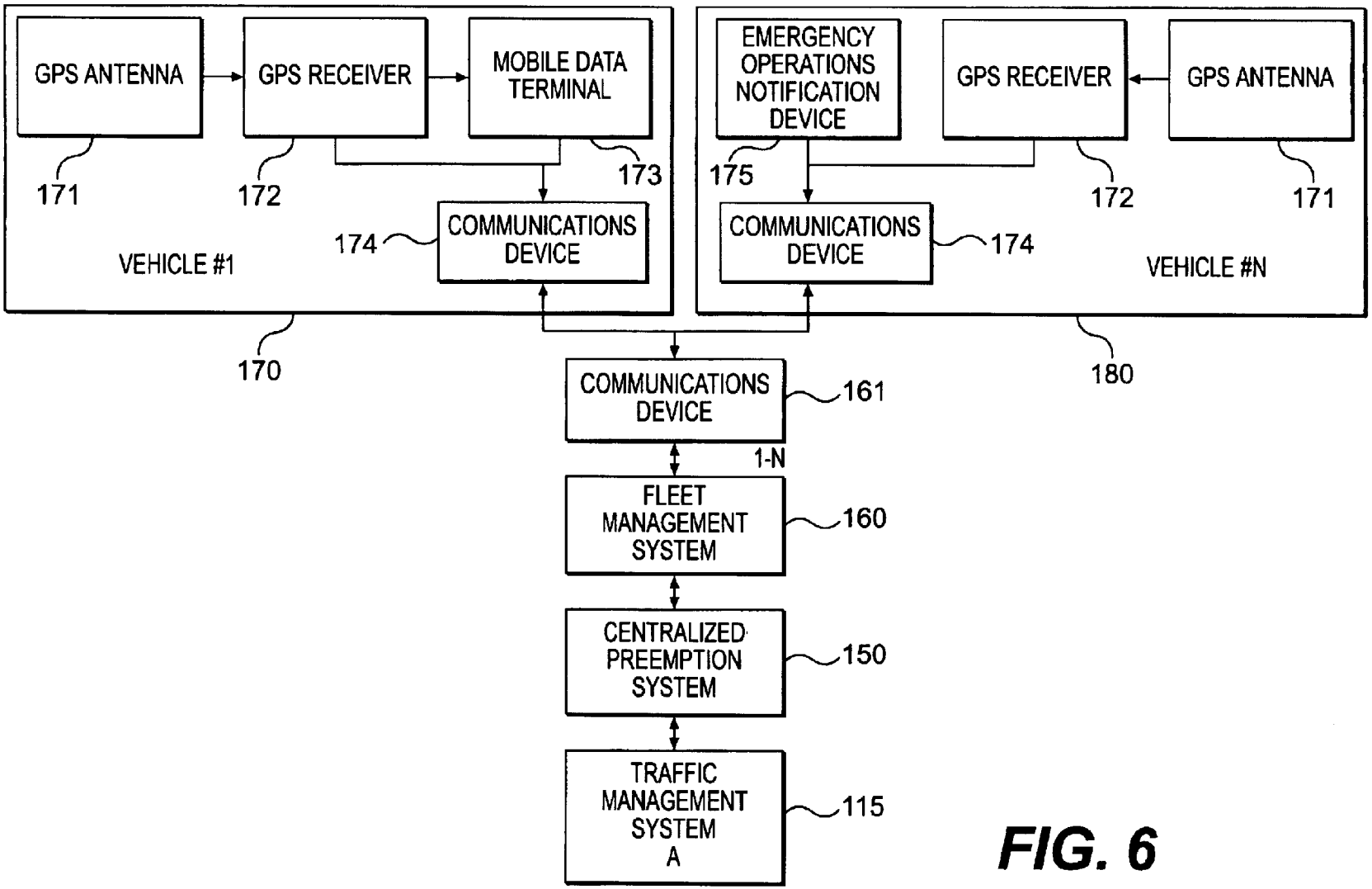
FIG. 6 is a block diagram showing another exemplary configuration according to an embodiment of the present invention.

FIG. 6 shows another embodiment of the present invention. In this embodiment, a centralized management system 150 is in communication with at least one TMS 115 and at least one FMS 160. The FMS 160 is in communication with at least one communications device 161 that is appropriate for the type of communication in use to communicate with exemplary EVs 170 and 180 (or 108 and 140). Multiple communication devices 161 may be employed, as necessary, if different modes of communications equipment are present in the EVs such as 170 and 180. EV 170 includes a GPS antenna 171, a GPS receiver 172, a mobile data terminal 173 (e.g., a computer terminal, a facsimile unit (FAX), a CDPD device, etc.) and communications devices 174 appropriate for all the equipment equipped in the EV 170. Similarly, the EV 180 includes as an example, a GPS antenna 171, a GPS receiver 172, and an emergency notification device 175, and one or more communication devices 174 appropriate for the equipment in the EV 180.

In FIG. 6, the emergency notification device 175 provides for recognizing when the EV 180 enters emergency operations mode and inserts an indication of entering or exiting the mode in the message transmissions from the EV 180 to the FMS 160 or CPS 150. Often this is associated with the state of the EV strobe lights or siren, but is not limited to this association. Caller and dispatch systems can also communicate directly with any of the EVs as needed.

Figure 7:
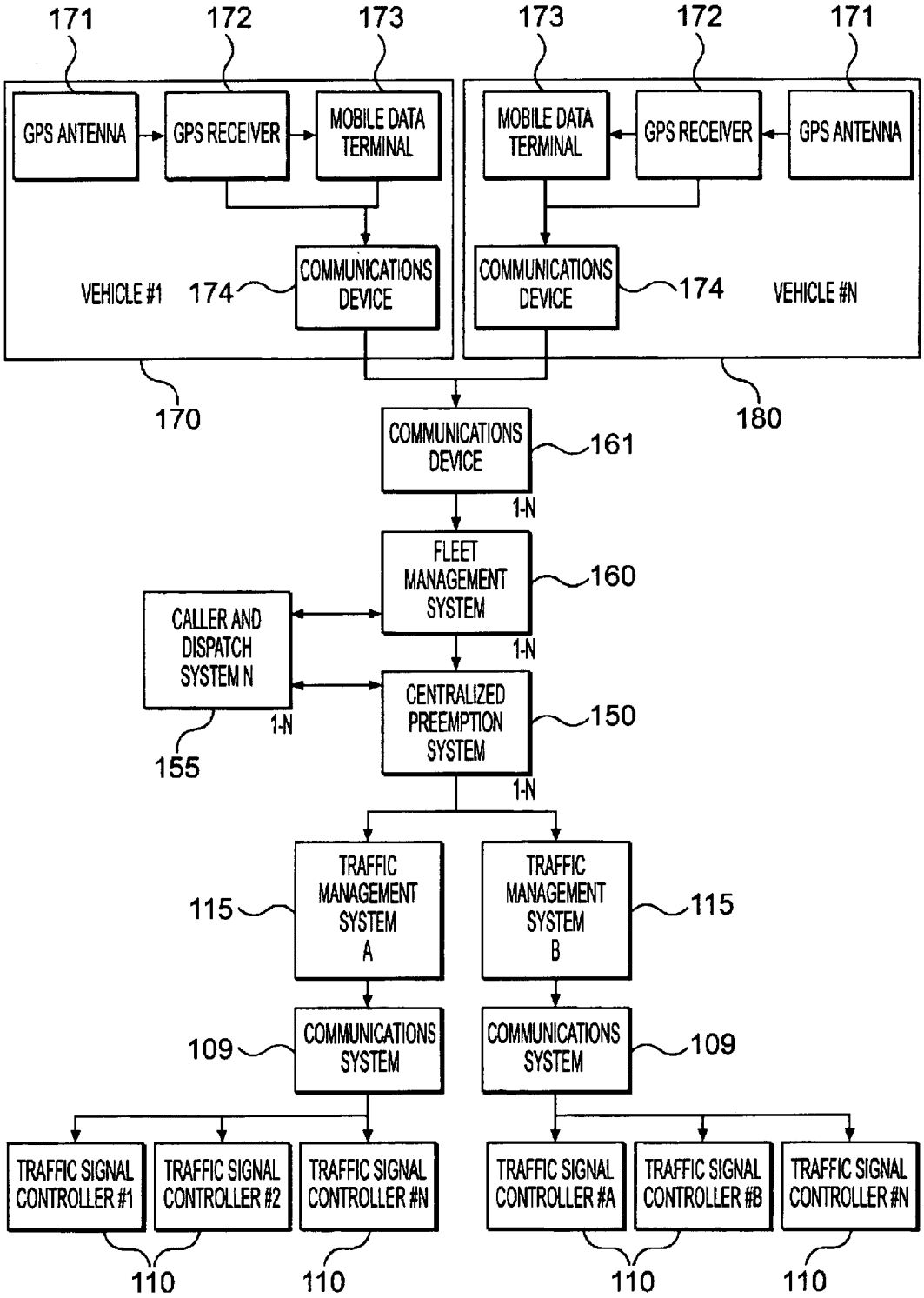
FIG. 7 is a block diagram showing another exemplary configuration according to the present invention.

FIG. 7 shows another example of the relationships of different components of the present invention by combining many of the components of FIGS. 5 and 6. By way of example, one or more CPS 150 may be in communication with one or more FMS 160 and one or more traffic management system 115. The manner of communication between any of these system components may take on various techniques as previously discussed above and may include the use of the Internet, for example. As further seen, one or more caller and dispatch systems 155 are in communication with the CPS 150 and the FMS 160. FIG. 7 further shows one or more communication systems 109 in communication with the TMS 115. The communication systems 109 are also in communication with different TSCs 108, and thus provide a communication link between the TMS 115 and the different TSCs 108. It is possible to integrate a CPS together with a FMS, caller and dispatch system, or a TMS.

As in previous embodiments, the CPS 150 is capable of providing comprehensive preemption policy application for multiple vehicles in different fleets and for multiple caller and dispatch systems throughout several different locales, etc. The CPS 150 can thus apply preemption plans on a broader scale and over wider regions even if the equipment involved in any EV is incompatible with equipment associated with any given traffic light controller 108. If the location of the EV (e.g., 170, etc.) can be provided by GPS (for example) via a FMS in real-time to the CPS 150, the location and direction of the EV can be tracked and appropriate intersection traffic lights preempted according to preemption policies pre-existing in the CPS 150. Any of the components of FIG. 7 may be in different jurisdictions. Combining of several of these components may also be possible to provide combined functions within one component.

In the system of the present invention, the CPS 150 includes necessary computer processing platforms and database access. It may also include access to geophysical databases in order that highway location reconciliation and mapping can be achieved. The CPS 150 also provides for traffic light preemption policies to be implemented. These policies can be any predetermined decision plans based upon anticipated traffic flows, emergencies, or other situations. It may also include factors such as vehicle types and jurisdictional considerations or directives. As examples for illustration purposes, these policies may include:

(i) priorities based on whether a traffic signal is controlled by an integrated traffic management system, (ii) intersections involved, (iii) agency requesting preemption, (iv) type of EV involved, type and level of an emergency itself, (v) location of EV and destination, (vi) time-of-day and day of week, holiday or work day, (vii) traffic density, (viii) requested route (ix) proposed route, (x) speed, (xi) direction and (xii) pre-prioritized other reasons in order to provide for broader emergency conditions. In short, any definable condition or factor can be implemented as a policy for emergency preemption with use of the present invention.

It is further contemplated that the CPS 150 may receive a request for best route availability from a FMS, caller and dispatch system, or emergency vehicle. When a destination or type of destination is requested, a route or possible alternate routes, potentially with alternate destinations, is provided taking into account the beginning location, time-factors, roadway conditions, traffic conditions, and preemption policies, etc. Proposed routes are then communicated back to the EVs (e.g., 100, 108, 140, 170, 180, etc.). A route rating may also be supplied indicating preferred choices or ranking.

Use of the Present Invention

The Centralized Preemption System may control and coordinate many thousands of intersection traffic lights with little, if any changes to existing equipment deployed in the field. In times of citywide or region-wide emergencies, such as for a hurricane or other imminent emergency, a broad traffic pattern change can be implemented to cause re-prioritized traffic light patterns for routes leading out of the city or a given direction. Additionally, as another example, in a case of a high-speed car pursuit, police departments could request that traffic lights along a particular highway section be made all red to stop all traffic. This may aid in controlling available criminal escape routes and may aid in reducing the possibility of innocent victims becoming part of an impact at an intersection.

Figure 8A:
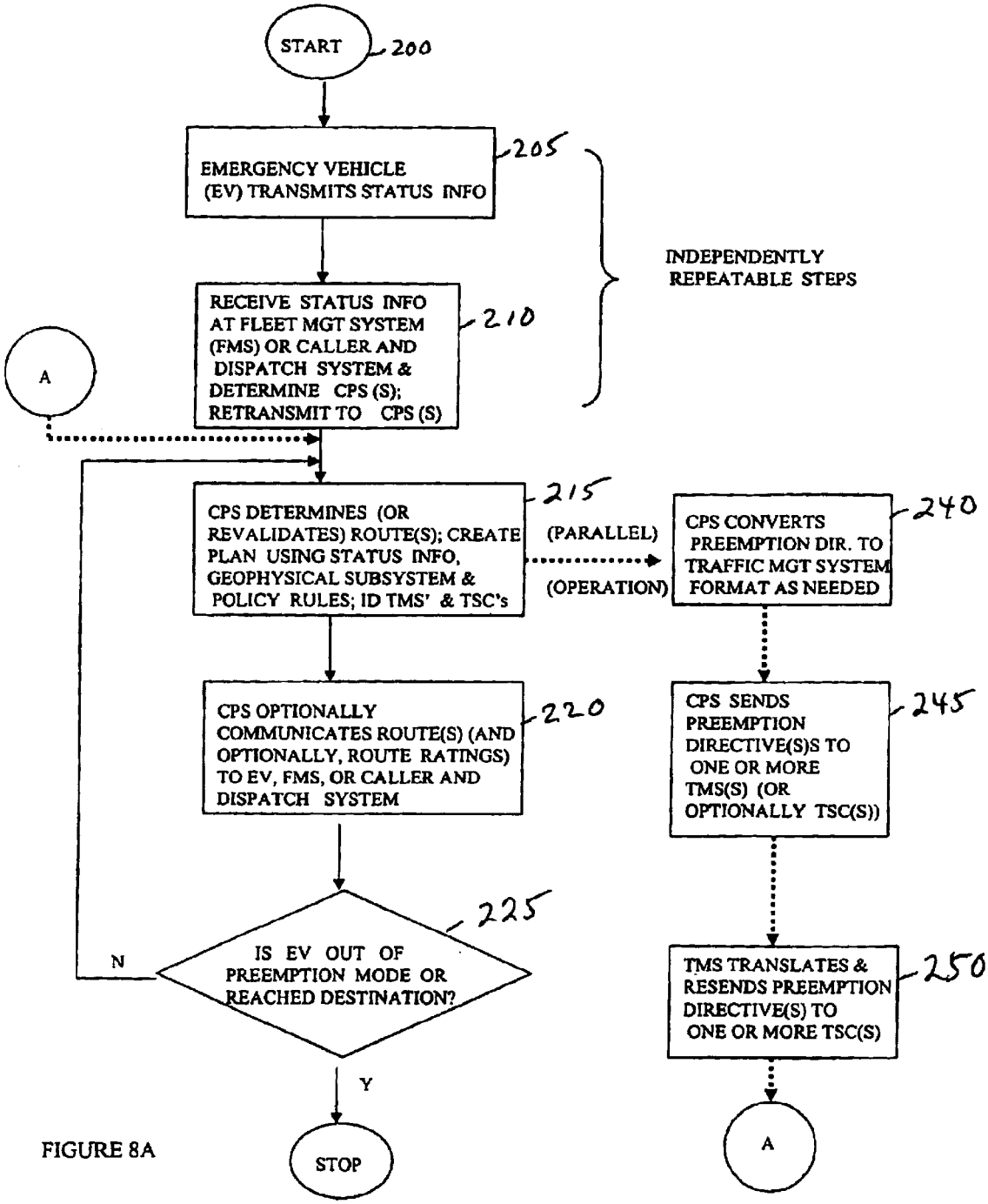
FIG. 8A is a flow diagram showing the steps of using the system of FIGS. 3-7.

Referring to FIG. 8A, a flow diagram shows the exemplary steps of using the present invention is shown. The flow diagram of FIG. 8A (and FIG. 8B) may equally represent a high-level block diagram of the present invention implementing the steps thereof. The steps of FIG. 8A (and FIG. 8B) may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM). Additionally, the computer program code can be transferred to a workstation over the Internet or some other type of network.

The process of FIG. 8A starts at step 200 and shows the process of using the system as presented in FIGS. 3–8. An EV transmits status information using available communication equipment at step 205. Assuming the status information includes emergency operations mode, at step 210, the status information is received at a FMS, or a caller and dispatch system, as appropriate, and is re-transmitted to a CPS.

At step 215, the CPS determines one or more routes using the status information, a geophysical subsystem, and pre-existing policy rules and creates a preemption plan. Continuing with one leg, at step 220, the CPS may optionally communicate any proposed route(s) (or respond to a request) to the EV, FMS, or caller and dispatch system as determined by operational conditions and parameters. The route(s) may be rated or prioritized. At step 225, a check is made whether the EV is out of preemption/emergency mode or has reached its destination, and if true, the process is concluded at step 230, all preempted traffic signals are also returned to normal operation, as necessary. If the EV is still in preemption mode and not at the destination, the process continues with step 215.

The other parallel leg starting with step 215 continues, as necessary, to deliver preemption type messages to the equipment controlling traffic intersections. At step 240, the CPS converts any information to a format required by the TMS(s). The CPS then transmits the preemption directives to one or more TMS, or optionally, if necessary, directly to one or more TSC at step 245. The TMS retransmits the preemption directives, with or without modifications to the directive, to one or more TSC indicated in the message (i.e., preemptive directive) from the CPS 250. The process then continues to step 215.

Figure 8B:
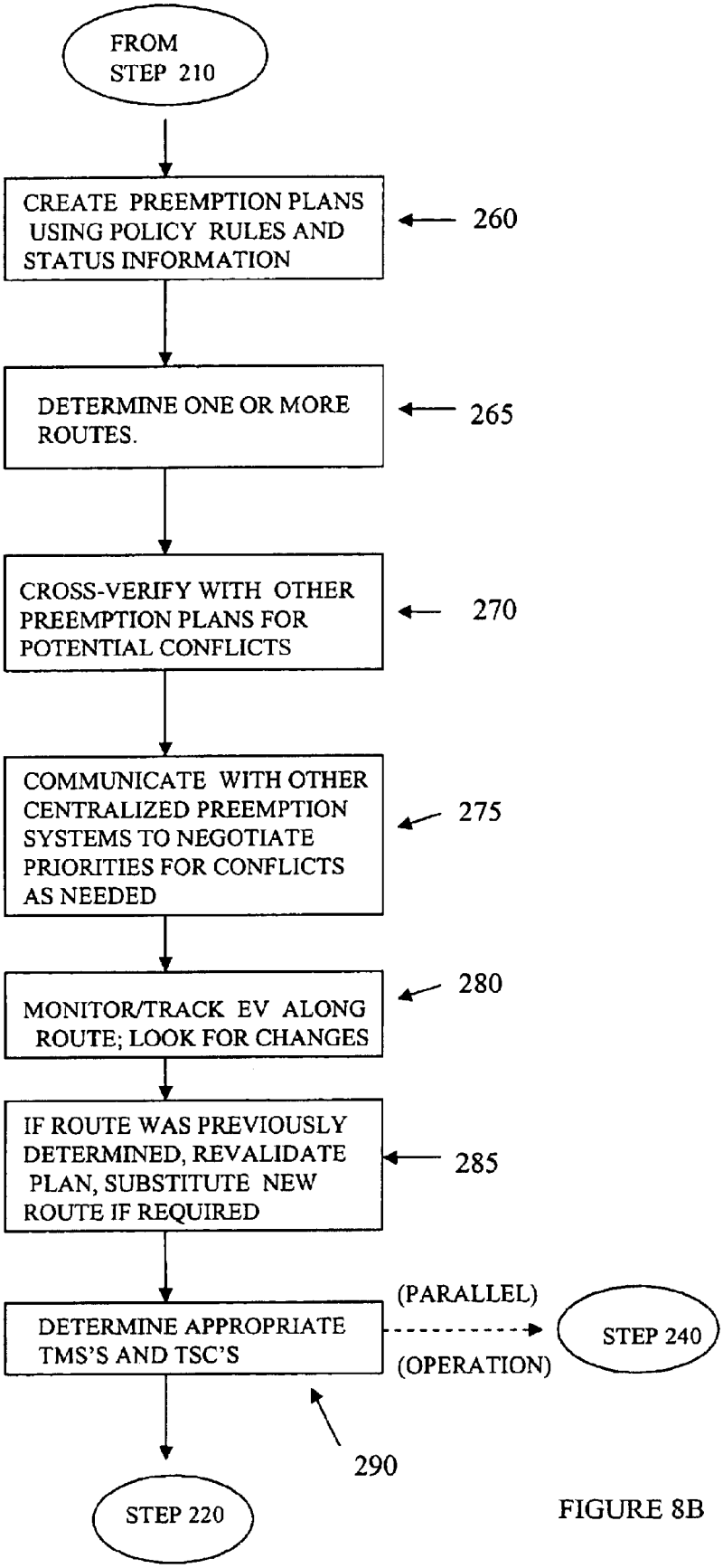
FIG. 8B is a flow diagram showing sub-steps of FIG. 8A.

FIG. 8B further details and expands on step 215 of FIG. 8A with sub-steps that begins by transitioning from step 210 of FIG. 8A. At step 260, one or more preemption plans are created using policy rules and real-time status information from the emergency vehicles, fleet management centers, or caller and dispatch center. This may include mapping the EV to a position on a roadway using a geophysical subsystem that is capable of GPS or other coordinate system. Policy rules are applied to determine probable routes. At step 265, the CPS determines routes based upon the preemption plan and associates the routes with the preemption plan. At step 270, the preemption plans are cross-verified with other preemption plans that may be in existence to determine if any conflicts exist in routes. At step 275, the CPS may communicate with another CPS to negotiate priorities as needed if conflicts exist. The CPS tracks the progress of the EV along the route in step 280. If a route was previously determined, it is revalidated to determine if a new route is more appropriate and, if so, a new route is substituted. At step 290, appropriate TMSs and TSCs are determined for the route according to the preemption plan. The steps continue with step 220 of FIG. 8A and in parallel with step 240 of FIG. 8A. It should be noted that in embodiments, the steps of FIG. 8B might occur asynchronously of one another.

While the invention has been described in terms of preferred embodiments, those skilled in the art will recognize that the invention can be practiced with modifications and in the spirit and scope of the appended claims.

Having thus described our invention, what we claim as new and desire by Letters Patent is as follows:

1. A method for preempting traffic signals at intersections, the method comprising:

transmitting status information from a vehicle including a request for preemption to a centralized preemption system;

determining a preemption plan by the centralized preemption system using policy rules and the status information; and sending a preemption directive to one or more traffic signal controllers related to a route, wherein the preemption directive causes the traffic signal controllers to alter a traffic signal cycle along the route based on results of the determining step.

2. The method of claim 1, further comprising the steps of:

monitoring vehicle location for changes in vehicle location; and revalidating the preemption plan as the vehicle transmits new status information.

3. The method of claim 1, further comprising the step of determining a route based on the preemption plan.

4. The method of claim 3, further comprising the step of sending the route to the vehicle.

5. The method of claim 1, wherein the policy rules include at least one of:

(i) whether a traffic signal is controlled by a traffic management system, (ii) intersections involved, (iii) agency requesting preemption, (iv) type of vehicle involved, (v) type of emergency, (vi) level of an emergency, (vii) location, (viii) destination of the vehicle, (ix) time-of-day, day of week, whether it is a holiday, whether it is a work day, (x) traffic density, (xi) requested route, (xii) proposed route, (xiii) direction, (xiv) agency requesting preemption, and (xv) speed.

6. The method of claim 1, wherein the status information includes at least one of location, agency requesting preemption, type of vehicle involved, mode of operation, destination, route request, level of emergency, speed, direction, traffic conditions and operational condition.

7. The method of claim 1, wherein the step of the sending preemption directive further includes sending the preemptive directive to one or more traffic management systems, the traffic management systems are in communication with the one or more traffic signal controllers.

8. The method of claim 7, wherein the traffic management system sends one of a modified and a non-modified preemptive directive to the one or more traffic signal controllers to alter traffic signal cycles along the route, and wherein the traffic signal cycles along the route return to normal operations.

9. The method of claim 1, wherein the route is developed according to a requested destination of the vehicle and the preemptive directive is issued based in part on projected arrival times of the vehicle at one or more intersections.

10. The method of claim 1, wherein the one or more traffic signal controllers are two or more traffic signal controllers of different models and the centralized preemption system translates the preemption directive into a format appropriate for each of the two or more traffic signal controllers of different models.

11. The method of claim 1, wherein the one of more traffic signal controllers are at least two or more traffic signal controllers, at least one of which is associated with a different jurisdiction.

12. The method of claim 1, wherein the policy rules are comprehensive policy rules that include policies from different localities and the preemptive directives are coordinated according to the policies from the different localities.

13. The method of claim 1, wherein the preemption plan is cross-checked with another preemption plan to check for conflicts in routes.

14. The method of claim 1, wherein the sending step includes sending the preemption directive to the one or more traffic signal controllers in a proper format when the equipment in the vehicle is incompatible with the traffic signal controllers.

15. The method of claim 1, further comprising requesting a best route to be determined by the centralized preemption system.

16. The method of claim 1, wherein the route is a projected path for the vehicle to traverse to reach a known destination and the route is known to both the central preemption system and the vehicle.

17. A method for preempting traffic signals at intersections for emergency vehicles, the method comprising:

transmitting status information including a request for preemption from a vehicle;

receiving the status information at a management system, the management system determining which one or more centralized preemption systems receives the status information;

retransmitting the status information to the determined one or more centralized preemption systems;

determining a preemption plan by the one or more determined centralized preemption systems using policy rules and the status information; and sending a preemption directive according to the preemption plan to one or more traffic signal controllers related to a route to thereby coordinate the one or more traffic signal controllers.

18. The method of claim 17, the step of the sending preemption directive includes sending the preemptive directive to one or more traffic management systems, the traffic management systems in communication with the one or more traffic signal controllers.

19. The method of claim 18, wherein the traffic management system sends one of a modified and a non-modified preemptive directive to the one or more traffic signal controllers to alter traffic signal cycles along the route, and then returns the traffic signal cycles along the route to normal operations.

20. The method of claim 17, wherein the status information includes at least one of location, agency requesting preemption, type of vehicle involved, mode of operation, destination, destination request, requested route, level of emergency, speed, direction, and operational condition.

21. The method of claim 17, wherein the preemption plan identifies at least the traffic management systems and traffic light signal controllers that are involved along a route and the preemption plan determines the preemption timing pattern for the traffic signal controllers.

22. The method of claim 17, wherein the policy rules include at least one of:

(i) whether a traffic signal is controlled by a traffic management system, (ii) intersections involved, (iii) an agency requesting preemption, (iv) type of vehicle involved, (v) type of emergency, (vi) severity of an emergency, (vii) location of the vehicle, (viii) destination of the vehicle, (ix) time-of-day, day of week, whether it is a holiday, whether it is a work day, (x) traffic density, (xi) requested emergency route, (xii) proposed route, (xiii) speed, and (xiv) direction.

23. The method of claim 17, further comprising the step of revalidating the route as subsequent status information arrives from the vehicle.

24. The method of claim 17, further comprising the step of sending a determined route to the vehicle according to the preemption plan.

25. The method of claim 17, wherein the preemption directive causes the traffic signal controllers to alter a traffic signal cycle.

26. The method of claim 17, wherein the determining a preemption plan step includes using a geophysical subsystem for tracking and associating the vehicle location along one or more routes.

27. The method of claim 17, wherein the management system is at least one of a fleet management system, a caller and dispatch system, and a centralized preemption system.

28. A system for centralizing traffic signal preemption, the system comprising:

a component for receiving status information including a request for preemption from an vehicle at a management system that determines which one or more centralized management systems should receive the status information;

a component for retransmitting the status information to the determined one or more centralized preemption systems;

a component for determining a route and a preemption plan using policy rules and the status information; and a component for sending a preemption directive according to the preemption plan to one or more traffic signal controllers related to the route, wherein the preemptive directives alters a traffic signal cycle.

29. The system of claim 28, wherein the policy rules include at least one of:

(i) whether a traffic signal is controlled by a traffic management system, (ii) intersections involved, (iii) an agency requesting preemption, (iv) type of vehicle involved, (v) type of emergency, (vi) severity of an emergency, (vii) location of the vehicle, (viii) destination of the vehicle, (ix) time-of-day, day of week, whether it is a holiday, whether it is a work day, (x) traffic density, (xi) requested emergency route (xii) proposed route, (xiii) speed, and (xiv) direction, wherein the status information includes at least one of location, agency requesting preemption, type of vehicle involved, mode of operation, destination, requested route, level of emergency, speed, direction, traffic conditions and operational condition.

* * * * *